343-754 SR
10/27/81 OR 4,297,709

United States Patent [19]
Cassel et al.

[11] 4,297,709
[45] Oct. 27, 1981

[54] LUNEBERG LENS ANTENNA

[75] Inventors: Knut E. Cassel; Bengt T. Molin, both of Järfälla, Sweden

[73] Assignee: U.S. Philips Corporation, New York, N.Y.

[21] Appl. No.: 114,490

[22] Filed: Jan. 23, 1980

[30] Foreign Application Priority Data

Feb. 6, 1979 [SE] Sweden ..... 7901047

[51] Int. Cl.[3] ..... H01Q 15/08
[52] U.S. Cl. ..... 343/754; 343/911 L
[58] Field of Search ..... 343/753, 754, 773, 854, 343/911 R, 911 L

[56] References Cited

U.S. PATENT DOCUMENTS 2,875,439 2/1959 Berkowitz ..... 343/911 L
3,392,394 7/1968 Caballero ..... 343/754
3,958,246 5/1976 Wohlers et al. ..... 343/754

*Primary Examiner*—Eli Lieberman
*Attorney, Agent, or Firm*—Thomas A. Briody; David R. Treacy; Robert J. Kraus

[57] ABSTRACT

A lens antenna of Luneberg type comprising a disc shaped dielectric element having radially varying diffration index or dielectric constant and surrounded on both plane sides by conductive metal planes. The antenna is preferably adapted for transmission of a wave which is polarized in an angle of 45° relative to the plane of the lens element and is characterized in that the distance between the conductive planes to an essential extent is formed by air or a dielectric having a corresponding dielectric constant.

7 Claims, 6 Drawing Figures

LUNEBERG LENS ANTENNA

Figure 1:
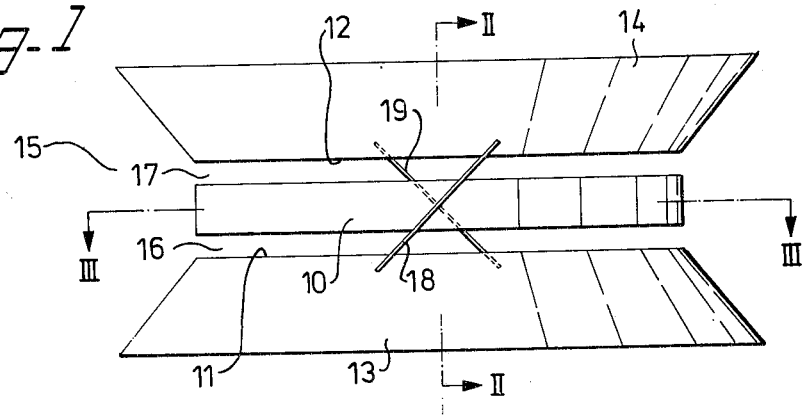

The invention relates to a lens antenna, preferably within the microwave range, comprising a round disc shaped lens element, for example a round disc of dielectric plastic material, having radially varying diffraction index (dielectric constant) surrounded on the plane sides by two conductive planes and having feeders distributed along at least a portion of the circumference, which feeders are so shaped and oriented that they transmit or are sensitive for reception, respectively, of a polarised wave, the polarisation direction of which forms an angle deviating essentially from 90°, preferably 45°, with the plane surfaces of the lens element.

Transmission of such a wave which is preferably polarised at 45° involves an E-component which is parallel with the metal planes transmitted together with an E-component which is perpendicular to the metal planes. If the lens is oriented horizontally the first wave can be called horizontal component and the last wave vertical component. These components are imposed to diffractions and delay (phase displacement) in the lens, the dielectric constant of which in the center of the disc has a value near 2.0 and is then reduced with a factor which is substantially proportional to the square of the normalized radial distance from the center. Generally, as soon as a horizontal component is to be transmitted requirements are laid upon the total thickness or height of the lens, i.e. the distance between the metal planes, while in case of transmission of only a vertical component the thickness or height of the lens can be selected substantially arbitrarily in view of the transmission through the lens. In case of transmission of a horizontal component, cut-off appears at a lens thickness equal to $\lambda/2$, where $\lambda$ is the wave length, and the total thickness of the lens thus must exceed half the wave length at the lowest frequency in order to be able to transmit a horizontal component. But furthermore there are requirements that the cross polarisation and so called bilobes are suppressed to the highest possible degree. By cross polarisation is meant a phase deviation between horizontal and vertical component, for example when these components emerge from the lens in the aperture of the same. An effective cross polarisation suppression requires that the horizontal and vertical components of the 45° polarized wave during transmission through the lens have nearly equally large total phase rotations or that they show a phase difference which approximates an integer times $2\pi$ radians. An improvement of the phase equality between horizontal and vertical component and thereby improved cross polarisation suppression is obtained by an increased lens height. The presence of so called bilobes is related to irregularities in the transmission phase rotation, i.e. the presence of electrically differing long radiation paths through the lens at transmission between its focal points and corresponding apertures. An effective bilobe suppression therefore requires an even phase across the aperture of the lens requiring that both the central and the peripheral rays in the lens have a small phase direction. Also the bilobe suppression increases with the lens height, as thus the ideal radial distribution of the dielectric constant for vertical and horizontal E-component, respectively, will differ more for lenses with small height.

An increase of the lens height, however, results in a decrease of the angle covered by the radiation of the antenna in a plane perpendicular to the plane limiting surfaces of the lens (or the vertical plane in the given example with horizontal lens). Thus a small height is desirable when the radiation covers a large angle in the said plane. A small lens height is also desirable due to the fact that the risk of appearance of higher modes, resulting in an unfavourable field distribution, increases with increasing lens height. Finally a large lens height involves an increase of the plastic volume (in a lens filled with dielectric plastic material) and thereby an increased price, weight and space.

The requirement for high cross polarisation suppression and high bilobe suppression, thus, is contrary to the requirement for a large angle of radiation in the said plane perpendicular to the lens plane, a strong suppression of higher modes and small weight, small space and small price.

The object of the invention is to decrease the lens height and thereby to achieve the advantages connected with small lens height while still maintaining the antenna criteria which are related to a higher or thicker lens.

According to the invention this is achieved by providing essential part of the distance between the conductive metal planes formed by air or a dielectric having a corresponding dielectric constant.

Antenna requirements relating to cross polarisation suppression and bilobe suppression can be maintained by decreasing the total distance between the conductive metal planes in this case to substantially half the value as compared with the corresponding distance in a lens which is completely filled with a plastic body. Of this distance approximately half the distance is formed by a dielectric with a varying diffraction index, while the rest is air. The thickness of the dielectric or the plastic body in the case of combination of a dielectric and air, thus, will be substantially four times smaller than in the case with completely filled lens.

In a first preferred embodiment of the invention the dielectric body is situated half way between the two conductive planes and is thus surrounded on both sides by equally large air gaps.

This will give the lens antenna a high pass character similar to the completely filled lens. An investigation of the resulting or effective dielectric constant for the combination of dielectric plastic body and air gap according to the invention reveals that the effective dielectric constant for the horizontal component is higher than that for the vertical component at the center of the lens, while near the periphery the opposite relationship prevails and the effective dielectric constant is higher for the vertical component than for the horizontal component. The value of the dielectric constant is decisive for the phase rotation of the respective wave and the result is that those differences in the phase rotation of the horizontal and the vertical components which are a result of the said differences in the effective dielectricity constant at the center and the periphery, respectively, will cancel each other and the horizontal and the vertical components will leave the lens with a small phase difference, over a very wide frequency range, of the magnitude of a number of octaves, above the cut-off frequency.

In another embodiment of the lens antenna according to the invention the lens element, for example the plastic body, lies directly against one of the conductive planes forming a horizontal lens against the lowest plane, whereby the whole air gap will be situated above the dielectric disc. In this case the antenna will have a band pass characteristic. A closer investigation shows that the effective dielectric constant in this case is appreciably larger for the vertical component, than for the horizontal component both at the center of the lens and at the circumference. For a suitable dimension of the lens the difference between the dielectric constant for the vertical and the horizontal components is sufficiently large so that the vertical component will leave the lens $2\pi$ electric radians later than the horizontal component, and thus be in phase, over a wide frequency range, of the magnitude of one to two octaves.

The invention is explained more detailed with reference to the drawings, where

Figure 2:
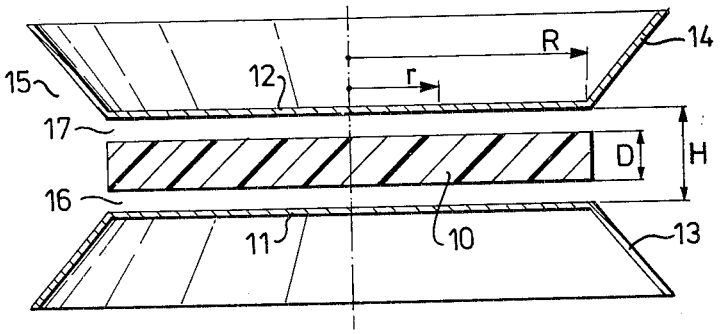
Figure 3:
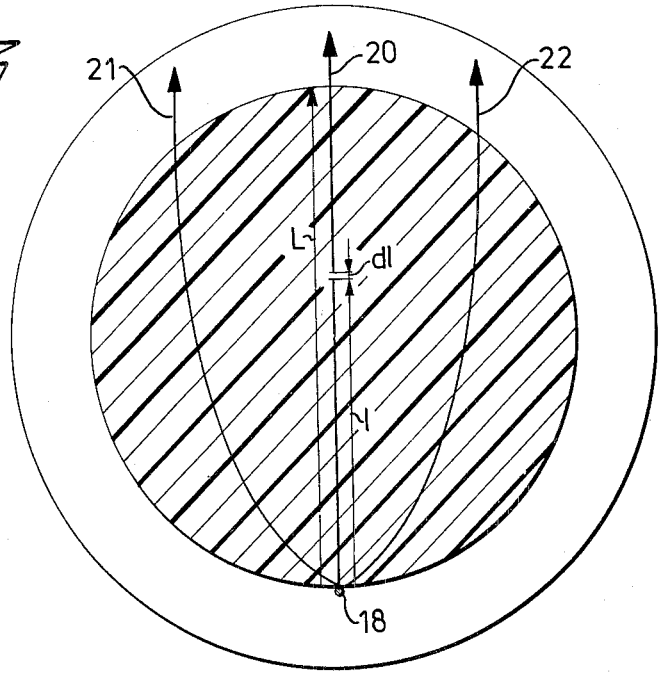
Figure 4:
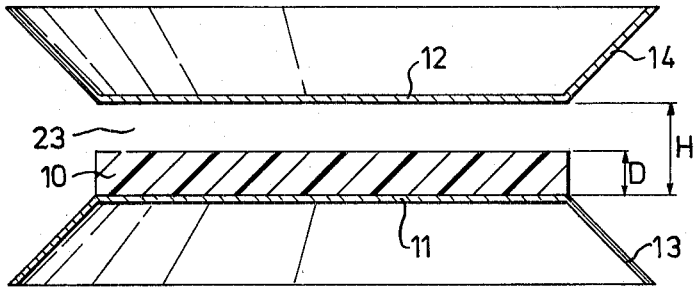
Figure 5:
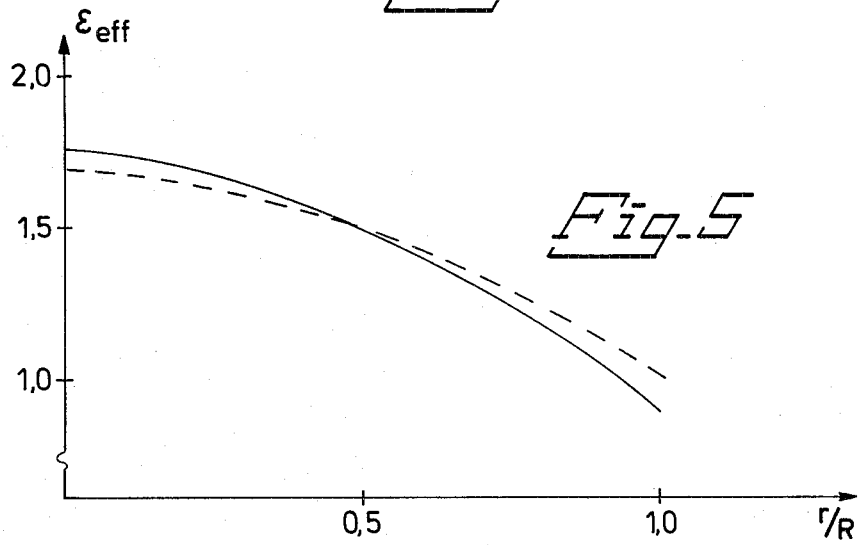
Figure 6:
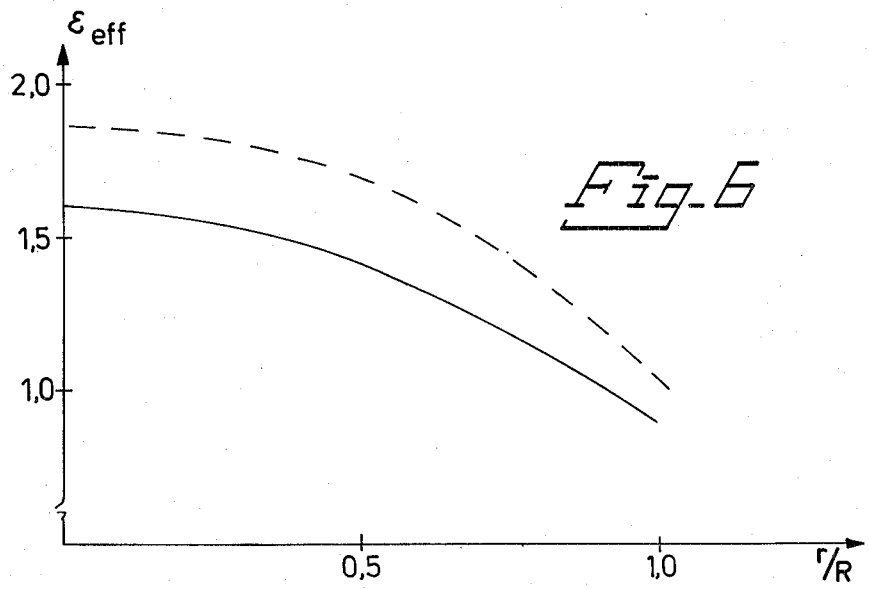

FIG. 1 shows a side view of a preferred embodiment of a lens antenna according to the invention, FIG. 2 shows a vertical sectional view through the lens taken along the line II—II, FIG. 3 shows a horizontal sectional view through the lens taken along the line III—III in FIG. 1 with three radiation paths shown, FIG. 4 shows a vertical sectional view through another embodiment of the lens antenna according to the invention, FIG. 5 shows a curve for the variation of the effective dielectric constant with the distance from the center of the lens according to FIGS. 1 and 2 provided that the dielectric disc per se is optimally dimensioned for vertical polarization and FIG. 6 shows a curve corresponding to the case according to FIG. 4.

The lens antenna as shown in FIGS. 1 and 2, is a circular disc 10 of dielectric plastic material, the dielectric constant of which increases in direction of the center of the disc. The disc is situated half way between two circular metal plates 11 and 12. At its circumference each metal plate forms an angular collar 13, 14 having the shape of a truncated cone, defining there between a funnel shaped space 15 extending round the whole circumference. The antenna is adapted for transmission of radiation which is polarised 45° relative to the lens plane and has for this purpose at least one feeder for such polarised radiation at its circumference. The feeders may for example cover the whole circumference and be shaped as described in the Swedish patent application 7901046-8, which is introduced as a reference. In accordance with this invention, the feeders are wire shaped and situated in a plane which, as seen radially, forms 45° with the lens plane. Two such wire shaped feeders designated 18 and 19 are indicated in FIG. 1, the feeder 19 being situated at the rear side of the lens. The feeders are symmetric and feeding is effected in the central point.

FIG. 3 shows the radiation in the horizontal plane for such a feeder, specifically the feeder 18, reference numeral 20 designating the central ray and 21 and 22 the two outermost rays in the lobe.

As is evident from the FIGS. 1 and 2 the thickness D of the disc 10 which is placed halfway between the conductive planes 11, 12 is essentially smaller than the distance H between the conductive metal planes 11 and 12 so that preferably equally large air gaps 16, 17 are formed on each side of the disc 10. Experiments have shown that optimal dimensioning is obtained if the thickness D of the disc 10 is of the same magnitude as the total thickness of the air gaps 16, 17. In the present example it is assumed that the dielectric disc per se is optimally dimensioned for a vertically polarised wave in accordance with the theory for a lens of so called Luneberg type, i.e. that $$\epsilon(r)=2-(r/R)^2$$

where $\epsilon(r)$ is the dielectricity constant, r is the radius relative to the center of the lens and R is the outer radius of the disc 10.

Dimensioning example:

$D=0.6\lambda$ $H=1.1\lambda$ $R=8\lambda$, where $\lambda$ is the wavelength in the disc 10.

The combination of the dielectric disc and the two air gaps on each side of the disc produces at each point a resulting or effective dielectricity constant $\lambda_{eff}$ which differs from the dielectricity constant $\lambda(r)$ for the disc alone. With the above given dimensioning of the dielectric disc (in the example optimal Luneberg dimensioning for the vertical component is assumed) and geometrical dimensioning of the disc and air gaps an $\epsilon_{eff}$ is obtained for the embodiment shown in FIGS. 1 and 2 as a function of r/R which is shown in FIG. 5. The dotted line in FIG. 5 shows the effective dielectric constant $\epsilon_{eff}$ for the vertical component and the full line shows the dielectricity constant $\epsilon_{eff}$ for the horizontal component. FIG. 5 is valid for a central ray but similar relationships will also be valid for other rays. It is evident from the Figure that $\epsilon_{eff}$ for the horizontal component is higher in the center of the lens ($r/R=0$) than $\epsilon_{eff}$ for the vertical component, while the opposite relationship prevails at the circumference of the lens ($r/R=1$). The total phase rotation $\phi$ for a wave from a feeder to the aperture at the opposite side of the lens is given by the expression:

$$\phi = \int_O^L \frac{360 \cdot \sqrt{\epsilon_{eff}}}{\lambda} \cdot dl$$

where l is the variable distance along the radiation path and L is the total length of the radiation path. It is obvious that the difference in phase rotation of the horizontal and vertical component for the actual central ray in the lobe, caused by the difference in $\epsilon_{eff}$ at the center of the radiation path (center of the lens), is counteracted by the difference in phase rotation of horizontal and vertical component, caused by the difference in $\epsilon_{eff}$ at the outer edges of the lens. Therefore, with a certain dimensioning the horizontal and vertical components will leave the lens approximately with equal phases, which is desirable. This has been verified by practical experiments which have shown that, if optimal dimensioning has been achieved so that the phase difference between vertical and horizontal component in the aperture of the antenna is zero or very small at a given frequency, this phase equality will be maintained with sufficient accuracy (phase difference smaller than about 30°) within a very wide frequency range covering a number of octaves. The antenna in this case will have a high pass character.

The deviation in the resulting or effective dielectric constant $\epsilon_{eff}$ relative to the ideal constant for a Luneberg lens ($\epsilon=2$ in the center of the lens and 1 at the periphery) results in the focus point being displaced from the periphery of the disc. The feeders to be placed in the focus are therefor placed at a distance from the periphery outside the same.

FIG. 4 shows a second embodiment of the invention where the dielectric disc 10 lies directly against the lower conductive plate 11, so that one single air gap 23 is formed above the disc 10. The horizontal dielectric disc 10 is also in this case assumed to be optimally dimensioned in the manner prescribed by Luneberg for a horizontal disc lens adapted for a vertically polarised wave. Thus it has a dielectric constant following the previously given relationship.

An example of geometrical dimensioning in this case is as follows:

$D=0.5\lambda$ $H=1.3\lambda$ $R=8\lambda$

A determination of the resulting or effective dielectric constant $\epsilon_{eff}$ for the combination of dielectric disc and air gap as function of the distance to the center of the lens at the given dimensioning and for a central ray in the lobe gives a result as shown in FIG. 6, where the full line is valid for the horizontal component and the dotted line for the vertical component.

It is evident that the effective dielectric constant $\epsilon_{eff}$ for the vertical component in this case is essentially higher than the corresponding effective dielectric constant for the horizontal component and that the difference between the coefficients is substantially constant from center of the lens to the periphery. The curves shown are valid for a central ray in the lobe but similar relationships will also be valid for peripheral rays. The vertical component will thus be delayed essentially more than the horizontal component. For a certain dimensioning of the antenna the vertical component will leave the lens $2\pi$ electrical radians later than the horizontal component and the two components are thus in phase in the aperture, which is desirable. This is approximately valid across the whole aperture. When such an optimal dimensioning has been achieved this relationship with approximately no phase difference or an acceptable phase difference between horizontal and vertical component ($<35°$) will be maintained within a wide frequency range of the magnitude 1–2 octaves. The antenna has a pass band character in this case.

What is claimed is:

1. An antenna comprising a round disc shaped lens element of the Luneberg type, having a radially varying diffraction index decreasing in the peripheral direction, surrounded on its planar sides by two conductive planes and having feeders distributed across at least a portion of the circumference, said feeders being shaped and oriented to transmit and receive, respectively, a polarized wave, the polarization direction of which forms an angle less than 90° with the plane of the lens element, a substantial portion of the distance between the conductive planes external to said lens element being formed by a dielectric medium having the dielectric constant of air, the thickness of said medium being substantially constant across the lens.

2. The antenna as claimed in claim 1, wherein the disc shaped lens element is situated half way between the conductive planes so that equally large dielectric media are on each side of the lens element.

3. The antenna as claimed in claim 1, wherein the disc shaped lens element is in contact with one of the conductive planes, so that one single dielectric medium is formed between the opposite side of the disc element and the opposite conductive plane.

4. The antenna as claimed in claim 1, wherein the thickness of the dielectric medium is of the same magnitude as the thickness of the disc shaped lens element.

5. The antenna as claimed in claim 1, wherein the total distance between the conductive planes is larger than $1\lambda$, at the lowest operation frequency, $\lambda$ being the wave length in air.

6. The antenna as claimed in claim 1, wherein the feeders have the shape of thin wires which are distributed round the whole circumference of the antenna, said wires lying in a plane forming 45° with the plane of the disc shaped lens element and bent to a symmetric shape in its own plane, feeding being effected at the symmetry point.

7. The antenna as claimed in any of the claims 1–6 wherein said dielectric medium is air.

* * * * *